US007162848B2

(12) United States Patent
Jacobs et al.

(10) Patent No.: US 7,162,848 B2
(45) Date of Patent: Jan. 16, 2007

(54) FILLING DEVICE WITH HOUSING HAVING A DIRECTED GAS SUPPLY

(75) Inventors: Thomas Gerardus Maria Jacobs, Hoog Keppel (NL); Louwrens Johannes Van Eijk, Nieuw-Vennep (NL)

(73) Assignee: Stork Food & Dairy Systems B.V. (NL)

( * ) Notice: Subject to any disclaimer, the term of this patent is extended or adjusted under 35 U.S.C. 154(b) by 0 days.

(21) Appl. No.: 10/498,655

(22) PCT Filed: Dec. 10, 2002

(86) PCT No.: PCT/NL02/00809

§ 371 (c)(1),
(2), (4) Date: Jun. 10, 2004

(87) PCT Pub. No.: WO03/051760

PCT Pub. Date: Jun. 26, 2003

(65) Prior Publication Data

US 2005/0076613 A1 Apr. 14, 2005

(30) Foreign Application Priority Data

Dec. 14, 2001 (NL) ..... 1019569
Dec. 14, 2001 (NL) ..... 1019570

(51) Int. Cl.
*B65B 17/00* (2006.01)

(52) U.S. Cl. ..... 53/167; 53/111 R; 53/266.1; 53/282

(58) Field of Classification Search ..... 53/111 R, 53/510, 266.1, 281, 282, 284, 167, 425; 141/92, 141/168, 57, 144; 422/26, 302, 303–304; 198/470.1, 478.1
See application file for complete search history.

(56) References Cited

U.S. PATENT DOCUMENTS

| | | | | |
|---|---|---|---|---|
| 3,566,575 | A | 3/1971 | Lisiecki | |
| 3,859,774 | A * | 1/1975 | Bausch | 53/167 |
| 4,597,242 | A | 7/1986 | Hendriks et al. | |
| 4,693,052 | A | 9/1987 | Rebmann et al. | |
| 5,022,165 | A | 6/1991 | Beswick | |
| 5,129,212 | A * | 7/1992 | Duffey et al. | 53/426 |

(Continued)

FOREIGN PATENT DOCUMENTS

| | | |
|---|---|---|
| CH | 530 307 | 11/1972 |

(Continued)

*Primary Examiner*—Hemant M. Desai
(74) *Attorney, Agent, or Firm*—Hoffman & Baron, LLP

(57) ABSTRACT

A filling device for filling containers with foods and closing the containers includes an endless conveyor system for conveying container holders; a container infeed mechanism for supplying containers to the container holders; workstations for carrying out operations on containers conveyed therealong, including a filling station and a closing station; a container discharge mechanism for removing containers from the container holders; at least one processing line provided along the conveyor track for containers to be processed; a housing that at least partially encloses the processing line; and gas supply means for feeding conditioned gases into the housing. The housing extends at least along the filling station and the closing station. Inside the housing, the gas supply means supply gas flow substantially close to filling apertures along outsides of containers. The gas supply means includes a plurality of adjacent gas outflow apertures opening into the housing.

29 Claims, 6 Drawing Sheets

U.S. PATENT DOCUMENTS

| | | | | |
|---|---|---|---|---|
| 5,534,222 | A * | 7/1996 | Kelbrick et al. | 422/33 |
| 5,650,693 | A * | 7/1997 | Campbell et al. | 315/111.21 |
| 6,209,591 | B1 | 4/2001 | Taggart | |
| 6,351,924 | B1 * | 3/2002 | Gustafsson et al. | 53/425 |
| 6,475,435 | B1 * | 11/2002 | Taggart | 422/33 |

FOREIGN PATENT DOCUMENTS

| | | |
|---|---|---|
| DE | 10 30 211 B | 5/1958 |
| DE | 296 16 138 U1 | 1/1997 |
| DE | 197 02 770 A1 | 7/1998 |
| GB | 2 089 191 A | 6/1982 |
| GB | 2 280 669 A | 2/1995 |

* cited by examiner

FILLING DEVICE WITH HOUSING HAVING A DIRECTED GAS SUPPLY

CROSS-REFERENCE TO RELATED APPLICATIONS

This application is the National Stage of International Application No. PCT/NL02100809, filed Dec. 10, 2002, which claims the benefit of Netherlands Application Nos. NL 1019570, filed Dec. 14, 2001, and NL 1019569, filed Dec. 14, 2001, the contents of which are incorporated by reference herein.

FIELD OF THE INVENTION

The invention relates to a filling device for filling containers with foods, in particular liquid foods. The device according to the invention here is of the type with an imaginary looped conveyor track having a bottom and a top track section, which sections are connected to each other by means of bend sections.

BACKGROUND OF THE INVENTION

A filling device according to the preamble of claim 1 is known, and the applicant has already been constructing and selling it under the name Exact Volume CE 87 for a number of years now. The device comprises endless conveyor chains on which a plurality of container holders are fastened. The endless chains convey the container holders along an imaginary looped conveyor track with the abovementioned bottom and top track sections. By driving the chains, the container holders are conveyed in succession along a container infeed mechanism, a decontamination station, a drying station, a filling station, a closing station and a container discharge mechanism. The infeed and discharge mechanisms and the plurality of workstations are all disposed along the top track section. The greater part of the filling device, including conveyor chains, drive unit with chain wheels and processing stations, is enclosed in a substantially sealing manner by a large housing, in other words with the exception of the container infeed mechanism and the container discharge mechanism. During operation, conditioned air is blown in at slightly positive pressure through a plurality of air infeed mechanisms in the top side of the housing. The slight positive pressure serves to prevent polluted ambient air from being able to flow inwards into the housing during the filling process, for example through the container infeed mechanism or container discharge mechanism.

A disadvantage in the case of this known device is that there is a risk of pollutants being released or finding their way inside the housing. Such pollutants in this case very soon extend over the entire processing line. Polluted particles may be released in particular in the case of the conveyor chains, the chain wheels and other moving parts of the conveyor system. If aseptic filling conditions are desired, the entire filling device inside the housing is treated with hydrogen peroxide before the actual filling process is started. During the filling process it is then difficult to keep all parts inside the housing sterile with sterile air. The shape and the size of the area around the processing line inside the housing do not permit this.

SUMMARY OF THE INVENTION

The object of the present invention is to overcome the abovementioned disadvantages at least partially, or to provide a useful alternative, and in particular to provide a compact filling device that is flexible in use, with an optimized processing functionality. More particularly, the object of the invention is to provide a filling device by means of which it is possible in a partially aseptic area still to fill and close containers under aseptic conditions.

This object is achieved by a filling device according to the present invention. In this case, a housing is provided along the processing line, which housing extends at least along the filling station and the closing station. Inside the housing gas supply means are disposed for substantially close to filling apertures make the gases flow along outsides of containers being conveyed along said housing, in the direction of bottoms of said containers. The gas supply means comprise a plurality of gas outflow apertures, in particular a large number disposed at intervals and opening into the housing. The number of the gas outflow apertures and their arrangement here are such that for substantially each conveyance position of a container along the housing, at least one of the gas outflow apertures is situated at a distance of less than 25 centimetres, in particular less than 15 centimetres, from the corresponding container filling aperture. This means that from the moment the containers are cleaned until the moment they are closed the filling apertures are situated at a short distance below the gas supply. The path taken by the gas from the gas outflow apertures to the filling apertures is consequently also short, with the result that the risk of pollution of the gases by polluted machine surfaces and/or mixing with polluted air is minimal. A substantially uniform flow of conditioned gases can therefore advantageously be achieved for each conveyance position of a container along the housing, in this case the introduced gases flowing in succession first along the filling apertures of the containers to be filled, and only then along the remainder of the outsides of the containers and parts of the conveyor system. Such a directed, substantially uniform flow of the conditioned gases prevents the spread of pollutants at the position of at least the filling apertures of individual containers. Furthermore, it is ensured that the most critical points during the filling process, i.e. the environment around the filling apertures of the containers during filling and closing, will not undesirably become polluted by dirt coming from the remainder of the outside of the container, or dirt coming from moving parts of the conveyor system. This advantageously also means that less high standards need be set for the cleanness of the outsides of the containers. For example, these outsides need no longer be made fully sterile, which produces both a gain in time and a cost saving.

The invention therefore makes it possible to keep the area around the processing line at the position of the housing only partially clean in a conditioned manner, in particular aseptic, while the filling and closing of the containers can still be performed in a reliable manner under the generally required aseptic conditions.

The containers are conveyed preferably upright in the container holders along the top track section. The gas outflow apertures in the housing are then designed to deliver the conditioned gases in a direction substantially perpendicular to the direction of conveyance.

In a further embodiment, provision is made for gas discharge means that connect to or, as regards the sphere of influence, at least partially extend into the heart of the conveyor system, in order to discharge laterally there at least part, in particular the greater part, of the gases introduced into the housing.

According to the invention, the housing with gas supply means also advantageously extends along a drying station disposed upstream of the filling station. From the moment the container has been cleaned and is to be filled with perishable foods and subsequently sealed, a desired direction of flow of conditioned gases along the containers can therefore be achieved. Prior to the drying station, a decontamination station can then be provided along the processing line, in order to decontaminate the insides of the containers and also a part around their filling apertures. According to the invention, this is sufficient, and the remainder of the outsides of the containers need no longer be decontaminated.

In particular, the housing is made at least partially tunnel-shaped, at least the part of the processing line that faces outwards being covered over. The covering leaves free a tunnel through which the containers to be filled can be conveyed along the stations. This gives the advantage that the area that has to be kept under certain processing conditions during operation, in particular the environment surrounding the filling apertures of the containers, is minimized. The number of parts, and also the surface area of these parts that is situated inside the housing, can also advantageously be minimized. The quantity of conditioned gases required is advantageously small.

In a further embodiment, the device comprises a conveyor system with container holders for conveying containers in a plurality of adjacent rows along workstations, the device being designed with a plurality of housing segments disposed adjacent to each other. Each housing segment individually encloses at least partially one or more of the rows of containers to be processed. Each at least partially individually enclosed row or number of rows of containers to be processed is defined as a processing line. The plurality of processing lines thus defined extend adjacent to each other along a common imaginary conveyor track. Each housing segment is individually connected to gas supply means.

According to the invention, individual processing conditions can advantageously prevail within each housing segment, for example the supply of different gases, the temperature, sterility, humidity etc. If one of the processing lines becomes polluted, this advantageously does not directly have the consequence that the other processing lines become polluted. If there is a fault in one of the processing lines, the device may, if desired, continue to operate for the other processing lines. The individual housing segments also make it possible expediently further to reduce the working area in which the filling operations have to be carried out, so that the desired processing conditions can be achieved and maintained in a simpler manner.

Further preferred embodiments of the invention are set out in the subclaims.

BRIEF DESCRIPTION OF THE DRAWINGS

The invention will be explained in greater detail with reference to the appended drawing, in which.

DETAILED DESCRIPTION OF PREFERRED EMBODIMENTS

Figure 1:
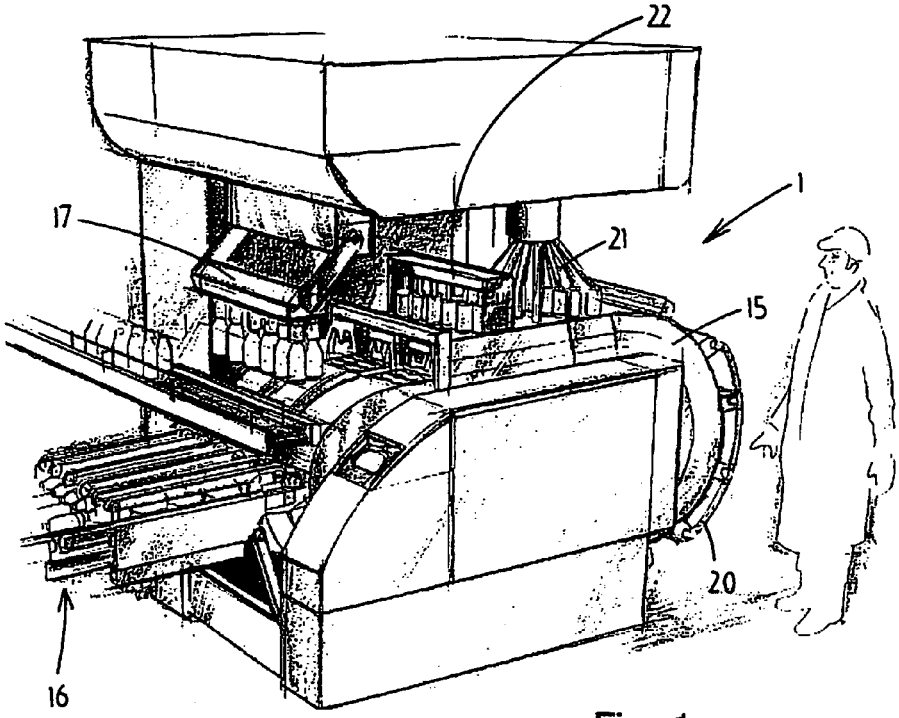
FIG. 1 is a view in perspective of a preferred embodiment of the filling device according to the invention.

The filling device is indicated in its entirety by the reference numeral 1 in FIGS. 1–4. The device 1 comprises an endless conveyor system 2, for conveying container holders 4 along an imaginary looped conveyor track by means of a drive 3. Each container holder 4 comprises means for positioning and supporting containers 5 that are to be filled. The container holders 4 are guided here along guide profiles 9, which extend along the conveyor track on either side.

The endless conveyor system 2 is of the type in which a top and a bottom track section 10 and 11 respectively can be distinguished. The top and bottom track sections 10 and 11 respectively merge into each other by way of bend sections 12. Inside the conveyor system 2 a central area 13 is bounded by the top and bottom track sections 10 and 11 respectively, the bend sections 12 and the drive 3.

In particular for substantially aseptic applications, the conveyor system 2 is at least partially enclosed by a plurality of adjacent housing segments 15. Each housing segment 15 encloses its own processing line, and leaves a container infeed mechanism 16 and a container discharge mechanism 17 clear. The processing lines extend along the imaginary conveyor track, and are each designed to process containers in a conditioned environment. To this end, a number of workstations are disposed along the conveyor track. For instance, a decontamination station 20 for decontamination of the insides of infed containers 5, a filling station 21 for filling the containers 5 with liquid foods, and a closing station 22 for closing the containers 5, for example with a cap, after filling are provided.

In the embodiment shown, an individual set of container holders 4 is conveyed along each processing line, each having room for a plurality of, preferably two, containers to be conveyed adjacent to each other. The plurality of housing segments 15 make it possible to operate the device very flexibly, and, for example, to fill containers in different conditions on the individual processing lines. In particular, it is possible in this way to maintain separate and substantially aseptic conditions more simply and reliably in the respective processing lines. Cross-contamination cannot occur between the processing lines, while a large number of parts such as drive, container infeed mechanism, container discharge mechanism, processing stations and/or gas supply and gas discharge means can be at least partially jointly used and driven.

The container infeed mechanisms 16 and the container discharge mechanisms 17 are situated substantially on the same side of the filling device. In the embodiment shown, the infeed mechanisms 16 are situated in the bend section 12 where the drive 3 is situated, and the discharge mechanisms 17 are situated in the end of the top track section 10 lying on the side of the drive 3. Automated infeed and discharge means are provided both at the infeed mechanisms 16 and at the discharge mechanisms 17. The automated infeed means comprise a supply conveyor belt. The automated discharge means comprise a drivable gripping arm.

The conveyor system 2 of the device is preferably driven intermittently, the conveyor system 2 each time advancing the container holders 4 one or more positions towards the next workstation. The intermittent drive leaves sufficient time free for carrying out the necessary operations at the workstations concerned.

The container holder 4 comprises retaining means 23, which here are formed by resilient clamping plates between which the containers can be clamped. The clamping here is such that the containers 5 also remain reliably retained if they are conveyed along the bottom track section 11, in other words hanging upside down. This has the advantage that the bottom track section 11 can also be used effectively for carrying out a processing step on the containers 5. In the embodiment shown, the decontamination station 20 is disposed partially along the bottom track section 11 and partially in the bend section 12 situated downstream. The part along the bottom track section 11 comprises spray nozzles for introducing cleaning medium into the insides of the containers. The cleaning medium largely runs out of the containers 5 again by itself, as a result of gravity. The part of the decontamination station 20 along the bend section 12 comprises blow nozzles for the removal of cleaning medium residue out of the insides of the containers. Through the use of the bottom track section 11 and the bend section 12 for carrying out on the containers or with the containers operations that are essential to the filling process, it is advantageously possible to construct the device in a very compact form. The conveyor system 2 with container holders 4 is designed for conveying the containers along the bend sections 12 with filling apertures of containers to be conveyed facing outwards in the radial direction. An operation to be carried out, here the removal of cleaning medium residue from the inside of the container, can be carried out efficiently as a result of this.

During operation, conditioned gases, in particular sterile air, are introduced by way of gas supply means 25 into each of the individual housing segments 15. This is preferably carried out at slightly positive pressure, in order to ensure that no polluted air can flow in through parts left open, such as the infeed mechanisms 16 or discharge mechanisms 17. The gas supply means 25 connect with separate nozzles to the respective outsides of the housing segments 15, preferably by means of gas supply nozzles lying at a distance from each other, which in this case are preferably provided for each of the housing segments 15 along all sections of the conveyor track.

Common gas discharge means, which are designed to connect to the central area 13 in the heart of the conveyor system 2, are further provided. Together with the supply of gases to the outsides of the individual housing segments 15, this means that during operation conditioned gases advantageously first flow along the most critical parts of the containers in which the filling apertures are situated, then flow by way of the outsides of the containers 5 and along the container holders 4, and ultimately arrive in the central area 13, where for all processing lines they are discharged by way of the common gas discharge means. The direction of flow of the gases achieved in this way inside each housing segment 15 is substantially perpendicular to the direction of conveyance of the containers holders 4, or directed towards the central area 13 of the conveyor system 2. The central area 13 according to the invention is advantageously compact, so that an efficient discharge is possible with the aid of the abovementioned gas discharge means.

The embodiment of the container holder 4 shown is designed with an open construction. This is achieved here by providing the bottom plate 30 of the container holder 4 with a large number of passage apertures 31. In a variant the bottom plate can be of an even more open-worked design.

The housing segments 15 are advantageously tunnel-shaped. The tunnel opening bounded by each housing segment, viewed in cross section, is selected here in such a way that two adjacent containers 5 at least with their filling aperture part can be conveyed through it in a close fit by means of the container holders 4. The volume of the filling area to be kept conditioned is consequently minimal. Driving parts of the workstations are situated as far as possible on the outside of the housing segments 15. This also makes it possible to keep to a minimum the filling area enclosed by the housing segments 15. Moving parts of the workstations in this case can be passed movably through walls of the housing segments 15 by means of elastic membranes.

More particularly, the housing segments 15 are endless tunnel-shaped housing segments, each housing segment largely enclosing its own processing line that runs around the conveyor track, leaving the corresponding infeed mechanism 16 and discharge mechanism 17 clear. The top and bottom track sections 10 and 11 respectively and also the bend sections 12 are enclosed here over a great part of their length. The workstations situated largely outside the housing segments 15 connect to the above in a sealing manner. Thanks to the slim shape of the housing segments 15, the desired direction of flow of conditioned gases inside each housing segment 15 can already be maintained with a slightly positive pressure.

The housing segments 15 are preferably of such a slim design that during operation they leave less than 25 centimetres, and more particularly less than 15 centimetres, clear above the filling apertures of the containers.

The housing segments 15 are preferably structurally connected to each other, in order to provide a strong complete unit.

Each housing segment 15 may be designed with inside housing walls that together bound the central area. The inside housing walls then have to be provided with gas outlets for connection to the gas discharge means. In the variant shown, such inside housing walls have been omitted, and the filling area of each processing line on the side facing the central area 13 is bounded by the open-work bottom plates 30 of the container holders 4.

By providing a plurality of individual housing segments 15 situated adjacent to each other, together with the specific arrangement of the gas supply means 25 and the central gas discharge means, a conditioned gas supply that is easy to control is produced in the filling area. The quantity of conditioned gases required can advantageously be small for each processing line, thanks to the very compact design of conveyor system 2 and the compact enclosing housing segments 15.

Figure 2:
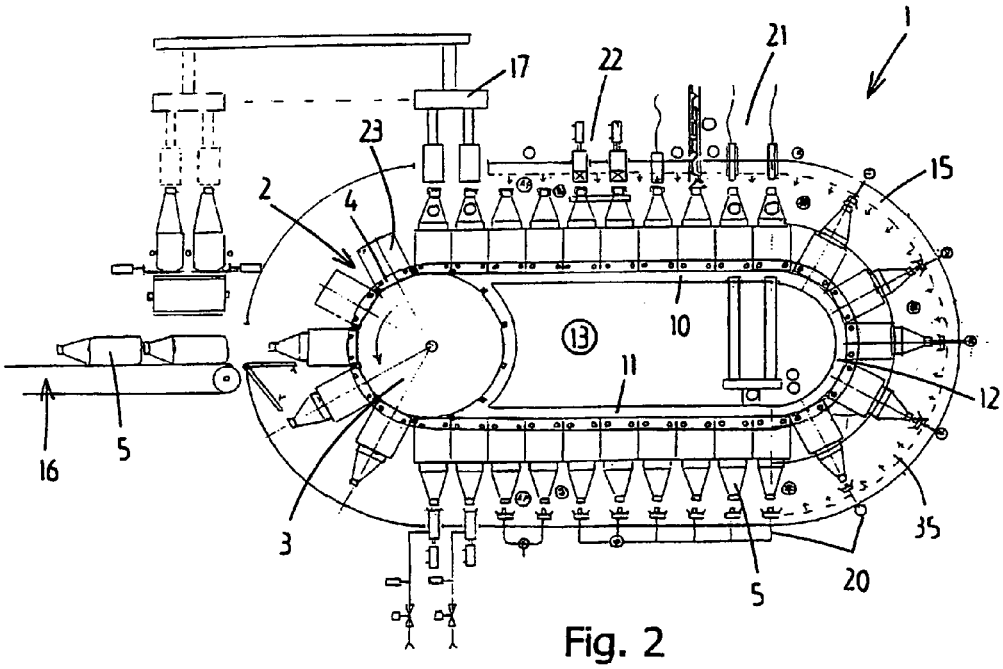
FIG. 2 is a diagrammatic view in cross section of FIG. 1.
Figure 3:
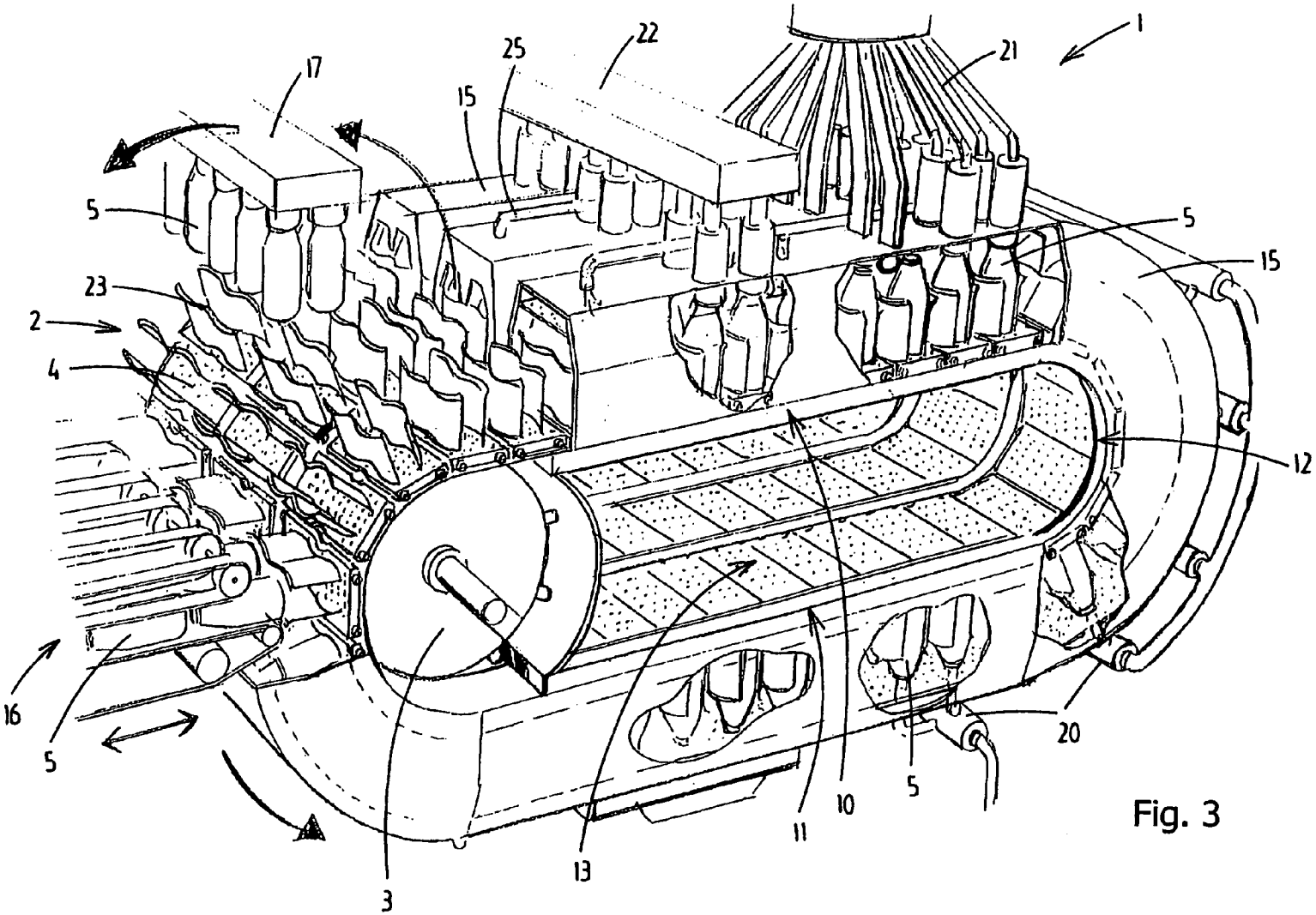
FIG. 3 is a partially cut-away partial view of FIG. 1.
Figure 4:
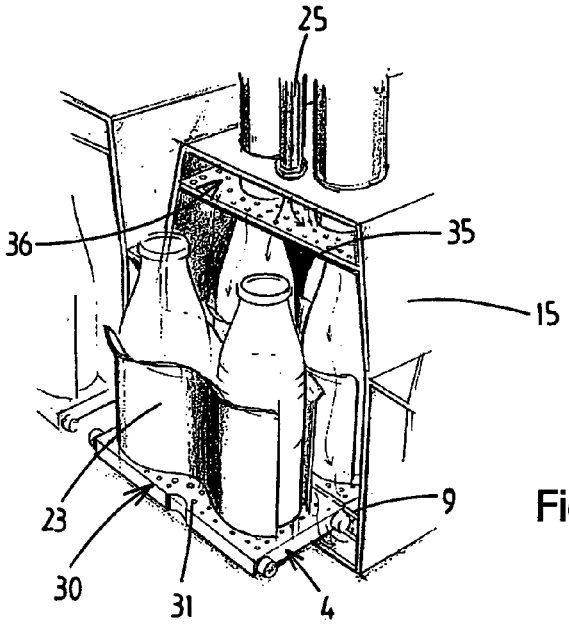
FIG. 4 is a cut-away view in perspective of the tunnel-shaped housing segment in FIG. 1, with container holder in use.

A gas distribution plate 35 is provided inside each housing segment 15, at some distance from the outside housing wall. In this way a gas distribution chamber 36 is formed between the housing walls and the distribution plate 35. The gas distribution plate 35 is provided with a large number of gas outflow apertures, which ensure that the gases fed into the chamber 36 by way of the gas supply means 25 are equally distributed among the containers 5 situated below said plate. In this way it will advantageously suffice to have a small number of gas supply nozzles for the gas supply means 25 lying further outside the housing segments 15. The large number of outflow apertures ensures that for each conveyance position the containers 5 below the gas distribution plate 35 lie with their filling apertures at a distance of less than 25 centimetres, in particular less than 15 centimetres, below at least one of the outflow apertures. The flow of the conditioned gases out of the outflow apertures is therefore substantially uniform or homogeneous, in particular substantially laminar, below the entire part of the housing segment 15 where the distribution plate 35 is provided. FIG. 2 shows diagrammatically with broken lines that the distribution plate 35 extends along the filling station 21 and closing station 22, and also along a part of the decontamination station 20, here the part comprising a drying station. This means that a substantially uniform flow of conditioned gases is achieved along the part of the processing line extending along the abovementioned stations, where the distribution plate is also provided, which flow is substantially directed from the container filling apertures to the bottoms of the containers.

The housing segment 15 here extends uniformly and in a compact manner along this part of the processing zone, and also along the remaining part of the processing line.

The embodiment of the filling device illustrated is particularly suitable for modular construction. By making the housing segments 15 and the conveyor system 2 modular, it is ensured that the device can be constructed in a larger, smaller, broader or narrower design, as the customer wishes.

The conveyor system 2 is preferably in the form of a chainless conveyor system. In the embodiment shown, this is achieved by making the container holders 4 advance one another, in this case a drivable wheel provided with pushing elements acting intermittently or continuously on some of the container holders 4 to push them. The guide profiles 9 here ensure that the container holders 4 continue to follow the imaginary looped conveyor track. The chainless conveyor system 2 designed in this way with guide profiles 9 provides for the guidance of the container holders 4 in the top and bottom track sections 10 and 11. The chainless conveyor system 2 has the advantage that it is cheaper and easier to clean and keep clean than, for example, a system with container holders advanced by chains. Furthermore, lubrication may be minimal or may even be dispensed with, and the chainless system is easy to make in a modular construction by the fact that the container holders need not be connected to each other. The invention can, however, also be used in conjunction with other types of conveyor systems, such as chain systems.

Figure 5:
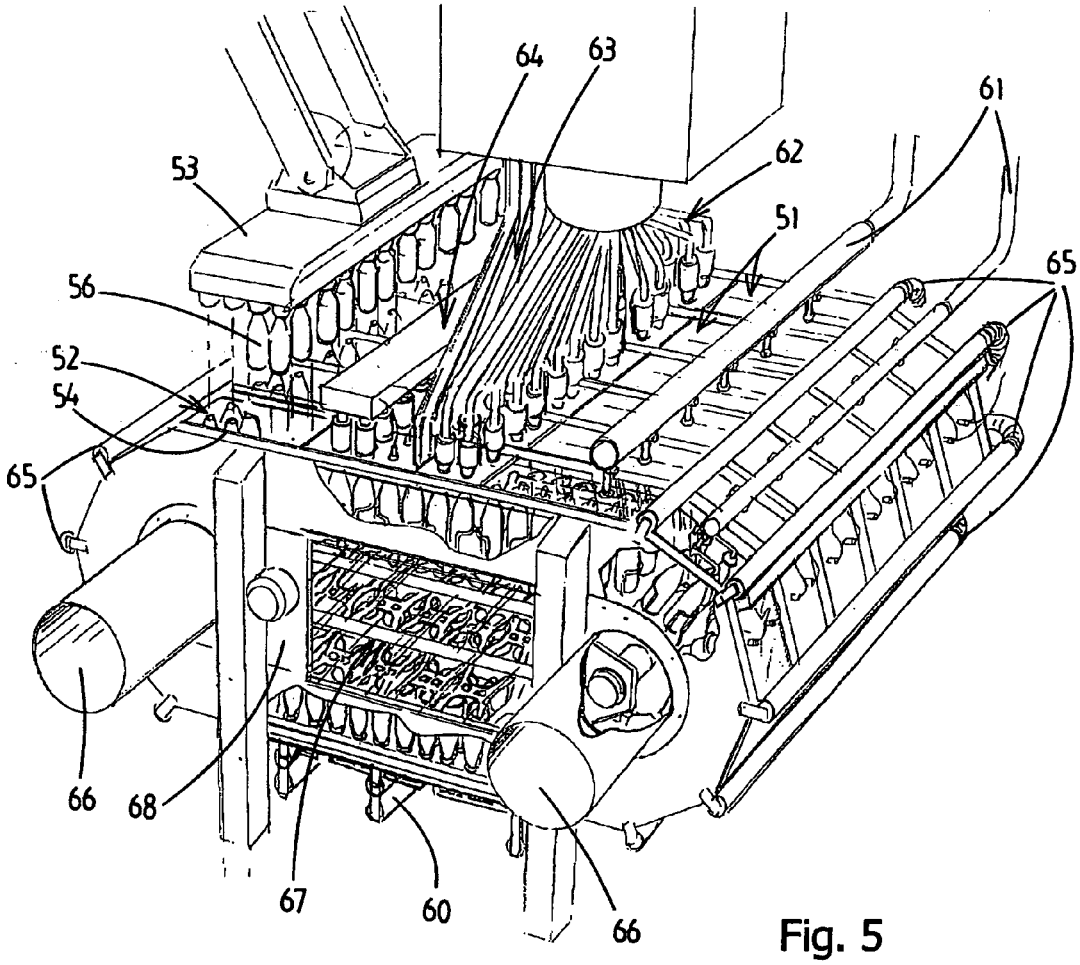
FIG. 5 is a partially cut-away view in perspective of a variant of an embodiment.

FIG. 5 shows a variant in the case of which the endless conveyor system of the filling device comprises a plurality of adjacent processing lines, each individually enclosed by a substantially endless tunnel-shaped housing segment 51. The housing segments 51 leave common container infeed mechanisms and discharge mechanisms 52 clear. The infeed mechanisms and discharge mechanisms 52 are situated close to the same bend section of the conveyor track. A common automated infeed and discharge mechanism 53 is advantageously provided, which device can both place empty containers 54 in container holders 55 and remove filled containers 56 from said holders. The container holders 55 are provided with retaining means 57, which here are designed with a resilient wire construction (see FIG. 6).

A number of common workstations are disposed along the processing lines, which workstations with their driving parts are situated at least partially outside the housing segments 51. A decontamination station 60 with residue-removing unit (drying unit) 61, a filling station 62, a closing element supply station 63 and a closing station 64 are therefore provided.

During operation, conditioned gases are introduced into the housing segments 51 by way of gas supply means 65. This is carried out at slightly positive pressure, in order to ensure that no polluted air can flow inwards through parts that have been left open, such as the infeed mechanisms and discharge mechanisms 52. The gas supply means 65 connect at several points to the outsides of the housing segments 51. Gas discharge means 66 are further provided, which discharge means connect to the central area 67 in the heart of the conveyor system. Between the laterally situated gas discharge means 66, the central area 67 is provided with a hatch 68 that can be slid open.

Profiled insert plates 70 are provided inside each housing segment 51, at some distance from the outside housing wall. The plates 70 reduce the filling area at the position of the filling apertures of the containers and ensure that the gases fed into the individual housing segments 51 by way of the gas supply means 65 are better distributed and directed towards the filling apertures of the containers. Here too, the conditioned gases therefore flow from the top in the direction of the filling apertures to the bottom of the containers.

Figure 6:
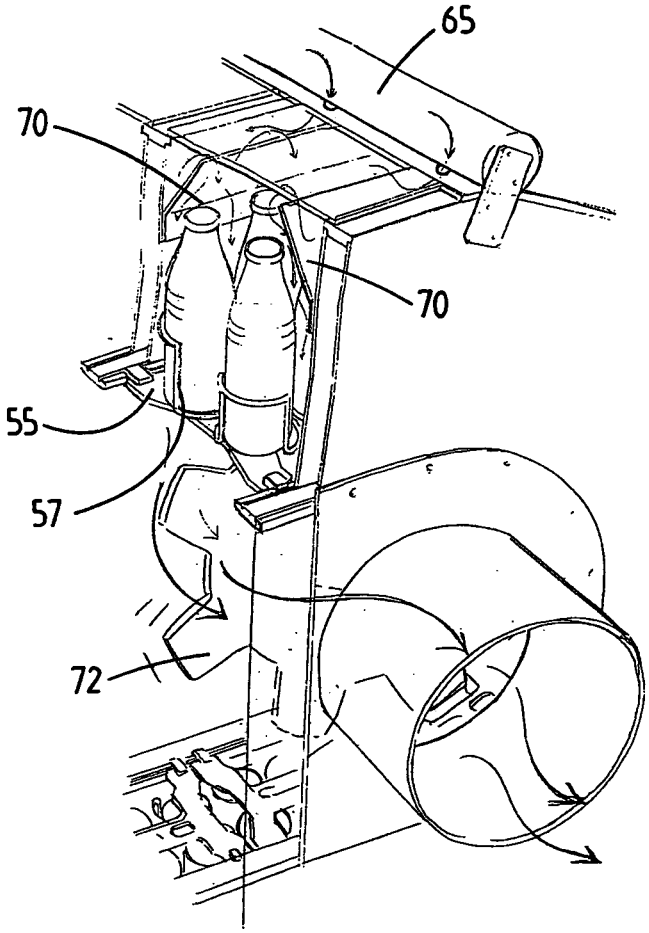
FIG. 6 is a cut-away partial view of FIG. 5.

FIG. 6 also shows an embodiment of a wheel provided with pushing elements 72. The pushing elements 72 are designed to act upon the container holders in front of them, in order to advance said container holders.

Figure 7:
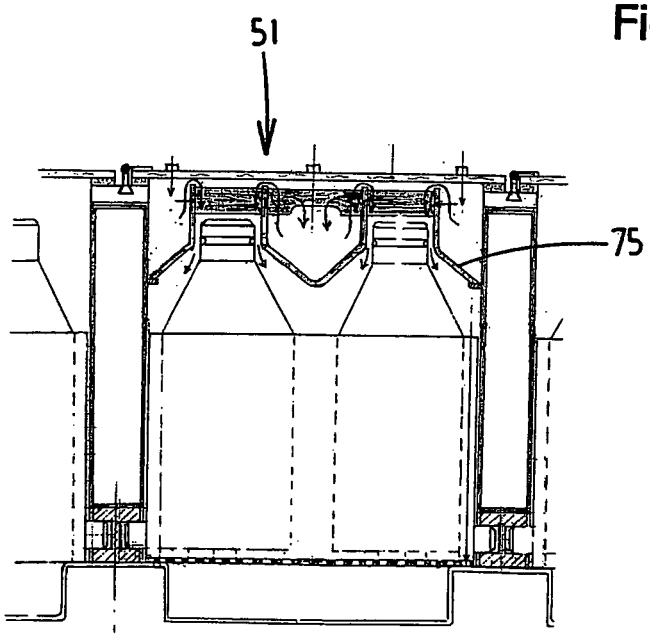
FIG. 7 is a view in cross section of the tunnel-shaped housing segment in FIG. 6, with in the top of the housing segment a variant of a profiled insert element for guiding gases.

FIG. 7 shows a variant of a distribution plate 75, which is disposed in the housing segment 51 and is advantageously of a profiled design corresponding to the shape of the top side of the containers to be filled. This means, on the one hand, that the filling space is further reduced and, on the other hand, that the desired gas flow direction can be achieved more quickly and more efficiently. In addition, the distribution plate is preferably of an exchangeable design, so that in the event of a different type of container having to be filled, an appropriate distribution plate can be fitted. Outside housing walls of the housing segments 51 may be made of transparent material, in order to be able to monitor the filling process better.

Providing an individual set of container holders for each processing line makes it advantageously possible to replace or exchange said container holders for a particular processing line, for example using a type that is suitable for a different size of container. This can then be carried out while filling proceeds on the other processing line. It is also possible to design the drive means in such a way here that each set of container holders is driven individually, if desired at different speeds.

The filling device may be designed with control means for supplying differing quantities and/or compositions of conditioned gases to the individual housing segments. Further flexibility can be achieved in this way, and the user can fill containers simultaneously as he wishes on the various processing lines under differing filling conditions that can be fully geared to the product for filling and/or the type of container to be filled.

Figure 8:
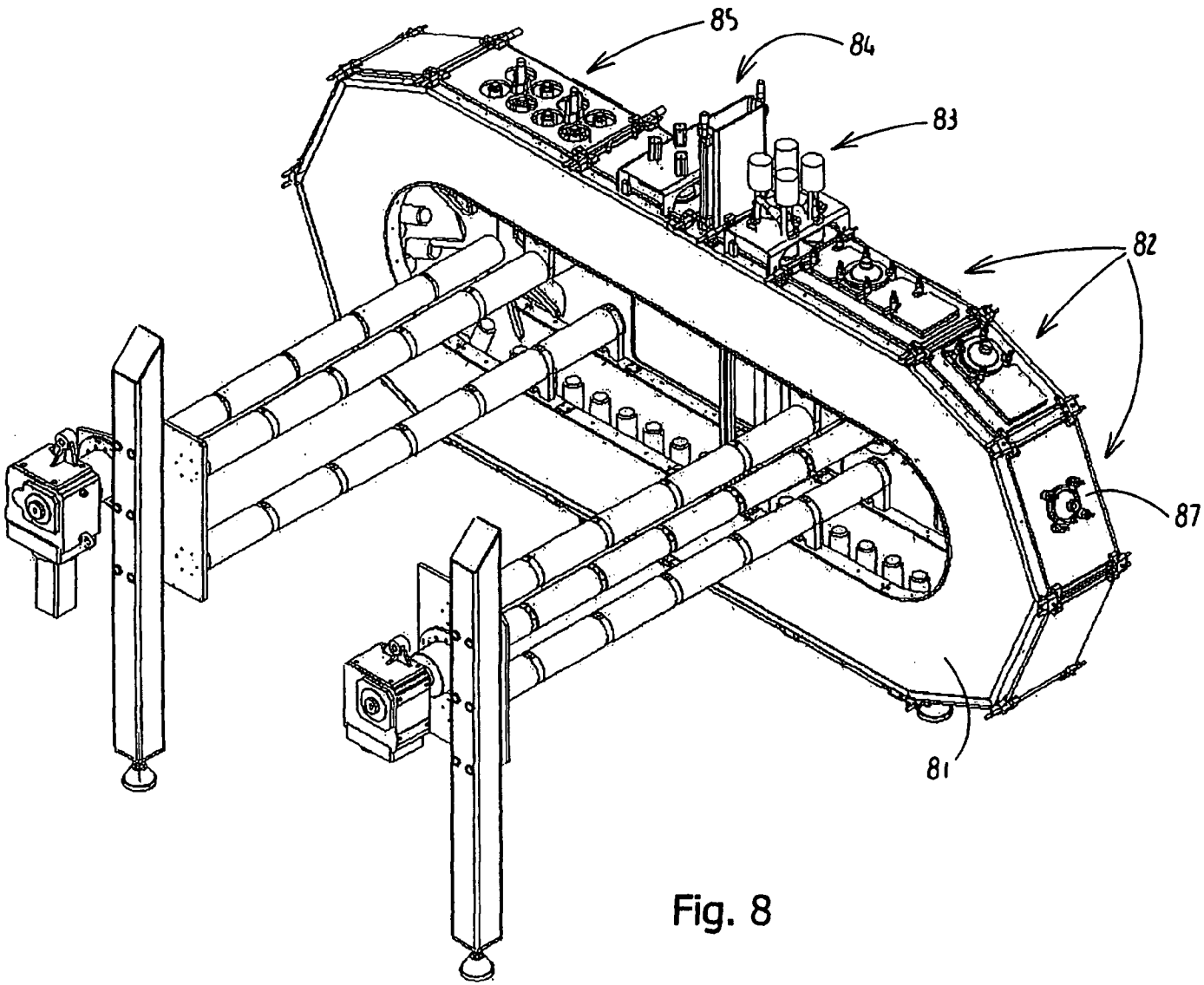
FIG. 8 is a view in perspective of a further variant, in which only one processing line is shown.
Figure 9:
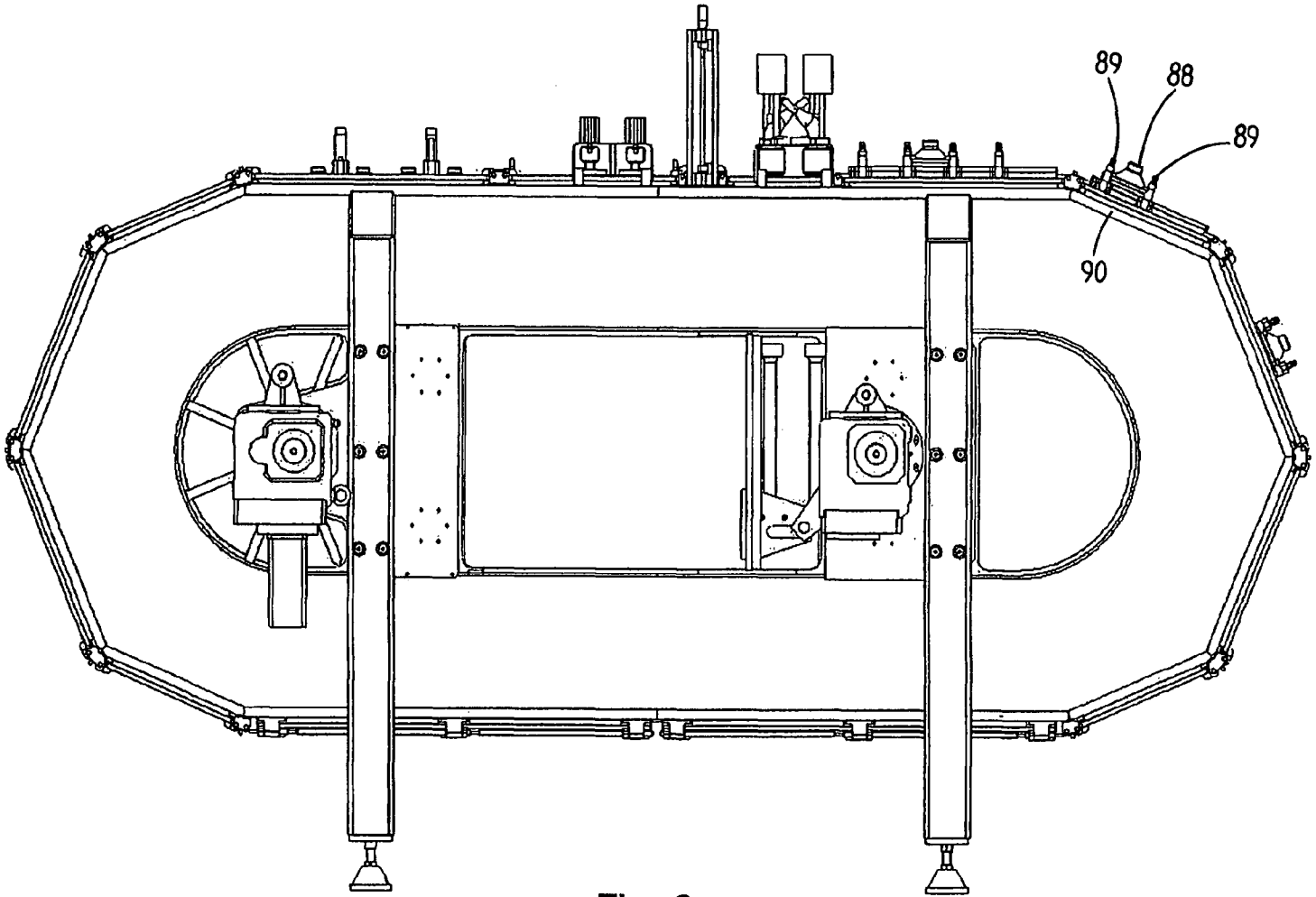
FIG. 9 is a side view of FIG. 8.

FIGS. 8 and 9 show a filling device that is suitable for a plurality of adjacent processing lines, each of which is individually enclosed by an endless tunnel-shaped housing segment 81, which is substantially uniformly designed along the entire processing line. Only the processing line furthest to the right is shown here. Provided along the processing line in succession are a drying station 82, a filling station 83 and a closing station 84. Infeed and discharge of containers is provided at the position of 85, where the housing segment 81 is provided with infeed and discharge apertures. At the position of the station 82, preliminary distribution elements 87 are provided, being fitted on the outside wall of the housing segment 81. Each preliminary distribution element 87 comprises a central infeed nozzle 88 and four infeed nozzles 89 surrounding it. The central infeed nozzle 88 is designed to be connected to gas supply means for the supply of conditioned gases, and opens into a gas distribution chamber that is bounded by wall parts of the housing segment 81 and a distribution plate 90 placed in said housing segment.

The infeed nozzles 89 are designed to be connected to drying air supply means, and merge into blow-in elements (not shown), which extend through the distribution plate 89 in the direction of the container filling apertures, and serve to make drying air flow inwards into four containers below said plate, and out of said containers along the filling apertures by way of the outsides of the containers in the direction of the bottoms of the containers.

It is possible here to use the same conditioned gases for the drying air as those supplied by the gas supply means for holding the critical processing zone in a conditioned atmosphere at the position of at least the filling apertures.

The filling device according to the invention is particularly suitable for filling containers under substantially aseptic filling conditions. To this end, the gas supply means are, for example, designed for supplying substantially sterile air.

The distribution plate can advantageously be in the form of a grille, in particular a fine-mesh grille with a mesh size of less than 1 centimetre. The use of such a grille has proved to be very effective in practice for obtaining below it a substantially uniform flow profile in the housing.

Many variants are possible in addition to the embodiments shown. For instance, a device may be designed with only one processing line and corresponding housing segment. The housing segment preferably extends uniformly along substantially the entire processing line. It is also possible for only part of the processing line to be covered by the housing segment, in which case this part comprises at least the part of the processing line along which the filling station and the closing station are disposed, and preferably also the drying station. In addition, the container holders can be designed with other retaining means, such as magnets or suction cups. It is also possible for the workstations to be provided only along one of the two track sections. The infeed and discharge of containers in this case may, if desired, be provided on opposite sides of this track section. Upside down conveyance is then no longer necessary, and the container holders can be provided with positioning means that no longer need to retain the containers, but now only to position them reliably. Instead of providing a separate set of container holders for each processing line, it is also possible to design the conveyor system with container holders that extend along a plurality of processing lines.

Thus according to the invention, a very compact construction of filling device is provided, by means of which filling can be carried out more cheaply and more efficiently, and by means of which conditioned filling conditions can be maintained reliably in the individual housing segments, in particular at the position of the filling apertures of the containers to be filled. Owing to the fact that the conditioned gas flows according to the invention do not flow along the conveyor system until after said gases have passed the critical environment at the container filling apertures, the invention can also already be used advantageously in conjunction with other types of conveyor systems, such as chain systems.

What is claimed is:

1. Filling device for filling containers with foods and closing said containers, comprising:

an endless conveyor system with drive means, for conveying container holders along an imaginary looped conveyor track with bottom and top track sections that are connected to each other by means of bend sections;

a container infeed mechanism, for supplying containers to the container holders, each of said containers having filling aperture;

workstations for carrying out operations on containers conveyed along, including a filling station and a closing station;

a container discharge mechanism, for removing containers from the container holders;

at least one processing line provided along the conveyor track, for containers to be processed;

a housing that at least partially encloses the processing line; and gas supply means, for feeding conditioned gases into the housing through a flow distribution part;

the workstations being disposed along the conveyor track, wherein the housing extends at least along the filling station and the closing station, along said housing said flow distribution part also extending at least along the filling and closing stations, wherein the gas supply means are designed for, during operation, making the gases flow from said flow distribution part to substantially close to the container filling apertures along outsides of containers being conveyed along said housing, in the direction of bottoms of said containers, said flow distribution part of said gas supply means comprising a plurality of adjacent gas outflow apertures opening into said housing extending at least along the filling and closing stations; and for substantially all conveyance positions of a containers along the housing extending at least along the filling and closing station, said gas flow distribution part having said gas outflow apertures being situated at a distance of less than 25 centimetres from the apertures of the corresponding containers.

2. Filling device according to claim 1, in which for substantially all conveyance positions of the containers along the housing extending at least along the filling and closing station, said gas flow distribution part having said gas outflow apertures being is situated at a distance of less than 15 centimetres from the apertures of the corresponding containers.

3. Filling device according to claim 1, in which the gas outflow apertures in the housing are designed to deliver the conditioned gases in a direction substantially perpendicular to the direction of conveyance.

4. Filling device according to claim 1, in which said flow distribution part of said gas supply means comprises a distribution plate, said distribution plate extending at least partially through the housing and together with housing walls of the housing forms a gas distribution chamber, and in which the gas outflow apertures of the gas supply means are provided in the distribution plate.

5. Filling device according to claim 4, in which the distribution plate is in the form of a grille, in particular with a mesh size of less than 1 centimetre.

6. Filling device according to claim 4, in which the distribution plate is of a profiled design corresponding to shape of top parts of the containers to be filled.

7. Filling device according to claim 1, in which the gas outflow apertures are designed to deliver the conditioned gases uniformly in substantially the entire housing.

8. Filling device according to claim 1, in which the gas outflow apertures are designed to blow the conditioned gases substantially from the top in the direction of the filling apertures of the containers.

9. Filling device according to claim 1, in which the gas outflow apertures are designed to deliver a substantially laminar flow.

10. Filling device according to claim 1, in which a central area is defined between the top and bottom track sections and the bend sections of the at least one processing line situated along the conveyor track, and in which gas discharge means are provided, for discharging by way of the central area at least part of the gases conveyed into the housing.

11. Filling device according to claim 1, in which the housing also extends along a drying station disposed upstream of the filling station along the conveyor track.

12. Filling device according to claim 1, in which the housing extends substantially uniformly along the plurality of workstations.

13. Filling device according to claim 1, in which the housing is made at least partially tunnel-shaped, with housing walls that enclose at least a part of the corresponding processing line that faces outwards.

14. Filling device according to claim 13, in which the housing is designed as a substantially endless tunnel-shaped housing segment, leaving clear the infeed and the discharge mechanism.

15. Filling device according to claim 1, in which driving parts of the workstations are situated substantially on the outside of the housing.

16. Filling device according to claim 1, in which the housing is designed to leave clear between the container filling apertures and the housing a space with a height of less than 25 centimetres.

17. Filling device according to claim 16, wherein the space has a height of less than 15 centimetres.

18. Filling device according to claim 1, in which the container discharge mechanism is provided downstream of the container infeed mechanism, viewed in the direction of conveyance, further past at least one of the two bend sections, and past at least a part of the bottom track section, in which the container holders are provided with retaining means for also conveying containers held substantially upside down, and in which the conveyor system is equipped with container holders for conveying containers substantially upright along at least part of the top track section, and for conveying the containers retained substantially upside down along at least part of the bottom track section.

19. Filling device according to claim 18, in which the container infeed mechanism and the container discharge mechanism are provided close to or along the same bend section of the conveyor track.

20. Filling device according to claim 1, in which the conveyor system with container holders is designed to convey the containers along at least one of the two bend sections with the filling apertures of containers to be conveyed facing outwards.

21. Filling device according to claim 1, in which at least one of the workstations is at least partially disposed along at least part of one of the two bend sections and/or the bottom track section, and in which the processing line is at least partially enclosed by the housing at the position of this workstation.

22. Filling device according to claim 21, in which the workstation is a decontamination station for decontaminating at least the insides of containers being conveyed along.

23. Filling device according to claim 1, in which the container infeed mechanism and the container discharge mechanism are provided close to each other along the conveyor track.

24. Filling device according to claim 1, in which a plurality of processing lines are provided adjacent to each other along the conveyor track, the housing comprising a plurality of housing segments disposed adjacent to each other and extending in the direction of conveyance, each housing segment at least partially enclosing one of the processing lines, and gas supply means connecting to each of the housing segments.

25. Filling device according to claim 24, in which a central area is defined in common between the top and bottom track sections and the bend sections of the plurality of processing lines lying adjacent to each other along the conveyor track, and in which gas discharge means are provided for discharging by way of the common central area at least part of the gases introduced into the plurality of housing segments situated adjacent to each other.

26. Filling device according to claim 24, in which the individual housing segments are connected to one another.

27. Filling device according to claim 24, in which at least one of the workstations extends over the plurality of processing lines.

28. Filling device according to claim 24, in which control means for supplying differing quantities and/or compositions of conditioned gases to the individual housing segments in a controllable manner are provided.

29. Filling device according to claim 24, in which the individual housing segments are connected to one another and comprise common side wall parts.

* * * * *